US011754027B2

(12) United States Patent
Suzuki

(10) Patent No.: US 11,754,027 B2
(45) Date of Patent: Sep. 12, 2023

(54) GASOLINE DIRECT INJECTION RAIL

(71) Applicant: USUI CO., LTD., Shizuoka (JP)

(72) Inventor: Shuji Suzuki, Shizuoka (JP)

(73) Assignee: USUI CO., LTD., Shizuoka (JP)

( * ) Notice: Subject to any disclaimer, the term of this patent is extended or adjusted under 35 U.S.C. 154(b) by 0 days.

(21) Appl. No.: 16/325,704

(22) PCT Filed: Jun. 26, 2017

(86) PCT No.: PCT/JP2017/023403
§ 371 (c)(1),
(2) Date: Feb. 14, 2019

(87) PCT Pub. No.: WO2018/037702
PCT Pub. Date: Mar. 1, 2018

(65) Prior Publication Data

US 2019/0203686 A1 Jul. 4, 2019

(51) Int. Cl.
*F02M 63/02* (2006.01)
*F02M 55/02* (2006.01)

(52) U.S. Cl.
CPC ..... *F02M 63/0275* (2013.01); *F02M 55/02* (2013.01); *F02M 55/025* (2013.01); *F02M 2200/315* (2013.01)

(58) Field of Classification Search
CPC .. F02M 63/0275; F02M 55/02; F02M 55/025; F02M 55/04
USPC ..... 123/456
See application file for complete search history.

(56) References Cited

U.S. PATENT DOCUMENTS 5,752,486 A * 5/1998 Nakashima ..... F02M 55/025 123/456
2005/0235963 A1* 10/2005 Kilgore ..... F02M 55/025 123/456
2006/0090736 A1* 5/2006 Nishiwaki ..... F02M 63/0205 123/456
2007/0169751 A1* 7/2007 Tominaga ..... F02M 55/025 123/456
2008/0178457 A1* 7/2008 Nagasaka ..... F02M 55/025 123/456

(Continued)

FOREIGN PATENT DOCUMENTS

EP 1653076 A 5/2006
JP H08261097 A * 3/1995

(Continued)

OTHER PUBLICATIONS

International Search Report for PCT/JP2017/023403 dated Aug. 15, 2017.

*Primary Examiner* — Logan M Kraft
*Assistant Examiner* — John D Bailey
(74) *Attorney, Agent, or Firm* — Yokoi & Co., U.S.A.; Toshiyuki Yokoi

(57) ABSTRACT

To obtain a gasoline direct injection rail provided with an inlet capable of reducing pressure pulsation without increasing the inner diameter of a high-pressure pipe even when the pressure of a system is increased. A gasoline direct injection rail comprises an inlet 2, 21 at a first end 15, 34 of a rail body 1, 20, wherein an orifice 12, 31 is provided inside the rail body 1, 20, the inlet 2, 21 has a fuel flow passage 4, 23, and a hollow part 8, 27 is provided between the fuel flow passage 4, 23 and the orifice 12, 31.

5 Claims, 3 Drawing Sheets

(56) References Cited

U.S. PATENT DOCUMENTS

| | | | | |
|---|---|---|---|---|
| 2009/0223486 | A1* | 9/2009 | Weizenauer | F02M 55/04 123/447 |
| 2011/0023818 | A1* | 2/2011 | Fulton | F02M 55/025 123/456 |
| 2014/0261330 | A1* | 9/2014 | Doherty | F02M 63/0275 123/456 |
| 2017/0306905 | A1* | 10/2017 | Usui | F02M 55/04 |
| 2019/0353126 | A1* | 11/2019 | Gerundt | F02M 63/0275 |
| 2020/0340436 | A1* | 10/2020 | Schenck Zu Schweinsberg | F02M 55/025 |

FOREIGN PATENT DOCUMENTS

| | | | | |
|---|---|---|---|---|
| JP | H09144624 | A | * | 11/1995 |
| JP | H08-246984 | A | | 9/1996 |
| JP | H08-261097 | A | | 10/1996 |
| JP | 2003049741 | A | * | 2/2003 |
| JP | 2012-097690 | A | | 5/2012 |
| JP | 2012-237298 | A | | 12/2012 |
| KR | 2010-0033785 | A | | 3/2010 |

* cited by examiner

GASOLINE DIRECT INJECTION RAIL

TECHNICAL FIELD

The present invention relates to a gasoline direct injection rail provided with an inlet.

BACKGROUND ART

To date, a method is generally known, which involves providing an orifice between a fuel supply port and a rail body to reduce pulsation of a fuel rail as disclosed in Patent Literature 1. By providing the orifice in this way, pressure fluctuation produced by a fuel pump can be reduced in the rail body.

In addition to the invention described in Patent Literature 1, a fuel rail is known in which an inlet (52) is securely placed at a first end (51) of a rail body (50) and in which an orifice (53) is provided in the inlet (52) to reduce pulsation of the fuel rail as shown in FIG. 3.

CITATION LIST

Patent Literature

Patent Literature 1: JP 2012-97690A

DISCLOSURE OF THE INVENTION

Problems to be Solved by the Invention

However, since future fuel injection systems will have increased pressure, pressure pulsation by the fuel pump is expected to be even greater in association with this increased pressure. In order to reduce pressure pulsation, it is necessary to not only provide an orifice between a fuel supply passage and a rail body as in the above-described conventional art but also increase the inner volume of a high-pressure pipe connecting a high-pressure pump and a fuel rail. In order to increase the inner volume of a high-pressure pipe, it is necessary to increase the inner diameter of the high-pressure pipe, but there is a limit to increasing the inner diameter due to concerns over the strength of the high-pressure pipe when the system has increased pressure. The use of a high-strength material can be contemplated to overcome such strength concerns, but is not realistic because high-strength materials are expensive and result in excessive costs.

Accordingly, an object of the present invention is to solve the above-described problem and to obtain a gasoline direct injection rail provided with an inlet capable of reducing pressure pulsation without increasing the inner diameter of a high-pressure pipe even when the system has increased pressure.

Means for Solving the Problem

The invention of the present application solves the above-described problem and is a gasoline direct injection rail provided with an inlet at a first end of a rail body, wherein an orifice is provided inside the rail body, the inlet has a fuel flow passage, and a hollow part is provided between the fuel flow passage and the orifice.

Providing the hollow part between the fuel flow passage and the orifice in this way makes it possible to increase the inner volume between the orifice and a high-pressure pump that is in communication with the inlet through a high-pressure pipe. It is thus possible to reduce pressure pulsation produced by the high-pressure pump. Accordingly, it is not necessary to increase the inner diameter of the high-pressure pipe, therefore it is also not necessary to utilize a high-strength material, and it is possible to suppress a cost increase.

The inlet may be a component separate from the rail body, may have an insertion part inserted into the rail body on a proximal end side opposite to a distal end side provided with the fuel flow passage, and may have the hollow part in the insertion part. Forming the inlet as a component separate from the rail body and providing the hollow part in the inlet in this way make it easy to place the hollow part in the rail body by attaching the inlet to the rail body, and therefore manufacturing can be simplified.

The orifice may have a plate shape and may be integrally provided in the insertion part of the inlet. Providing the orifice integrally with the insertion part of the inlet in this way makes it possible to simultaneously attach the orifice and the inlet during attachment to the rail body, and therefore attachment can be facilitated.

The orifice may have a plate shape and may be provided as a component separate from the inlet and the rail body.

Effects of the Invention

As described above, according to the invention of the present application, providing the hollow part between the fuel flow passage and the orifice makes it possible to provide a large inner volume between the orifice and a high-pressure pump that is in communication with the inlet through a high-pressure pipe. It is thus possible to reduce pressure pulsation produced by the high-pressure pump. Accordingly, it is not necessary to increase the inner diameter of the high-pressure pipe, therefore it is also not necessary to utilize a high-strength material, and it is possible to suppress a cost increase.

MODES FOR CARRYING OUT THE INVENTION

First Embodiment

Figure 1:
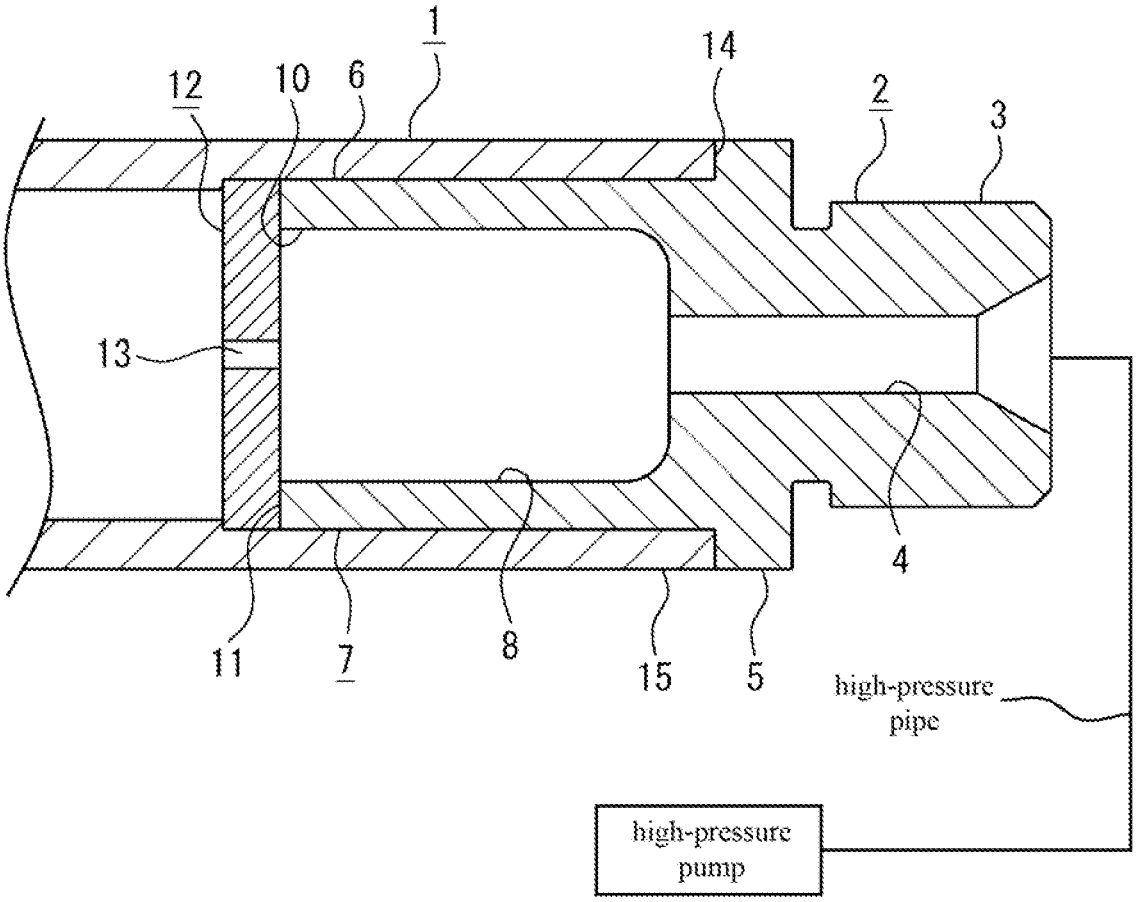
FIG. 1 is a partially enlarged cross-sectional view showing the first embodiment of the present invention.
Figure 2:
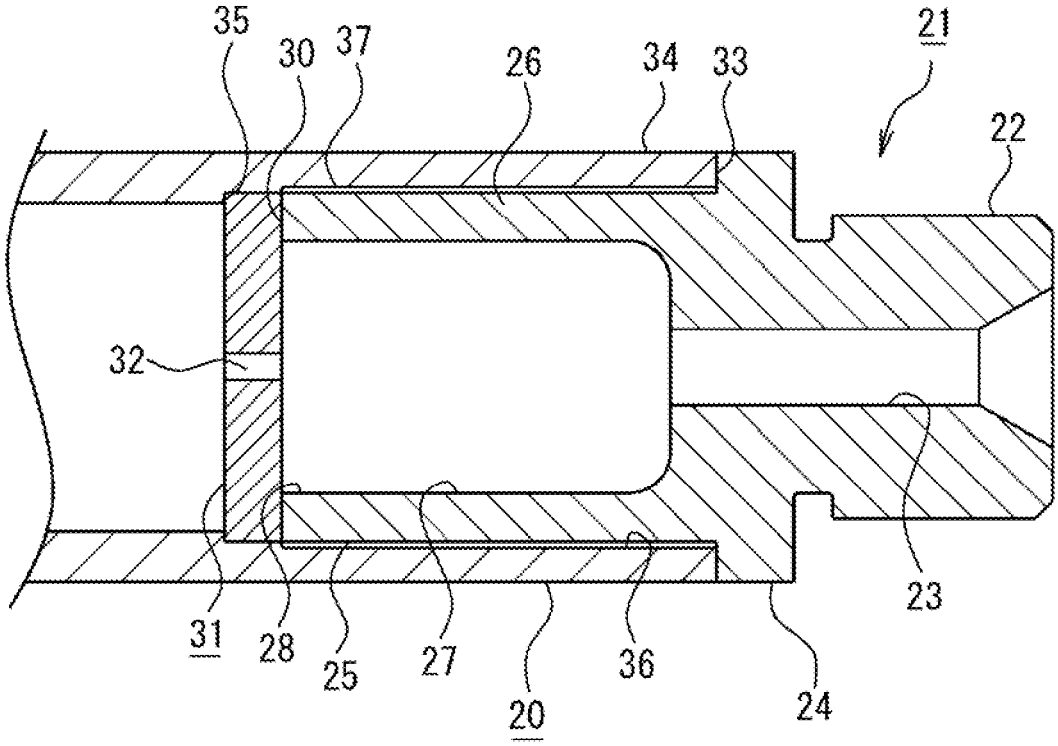
FIG. 2 is a partially enlarged cross-sectional view of the second embodiment.
Figure 3:
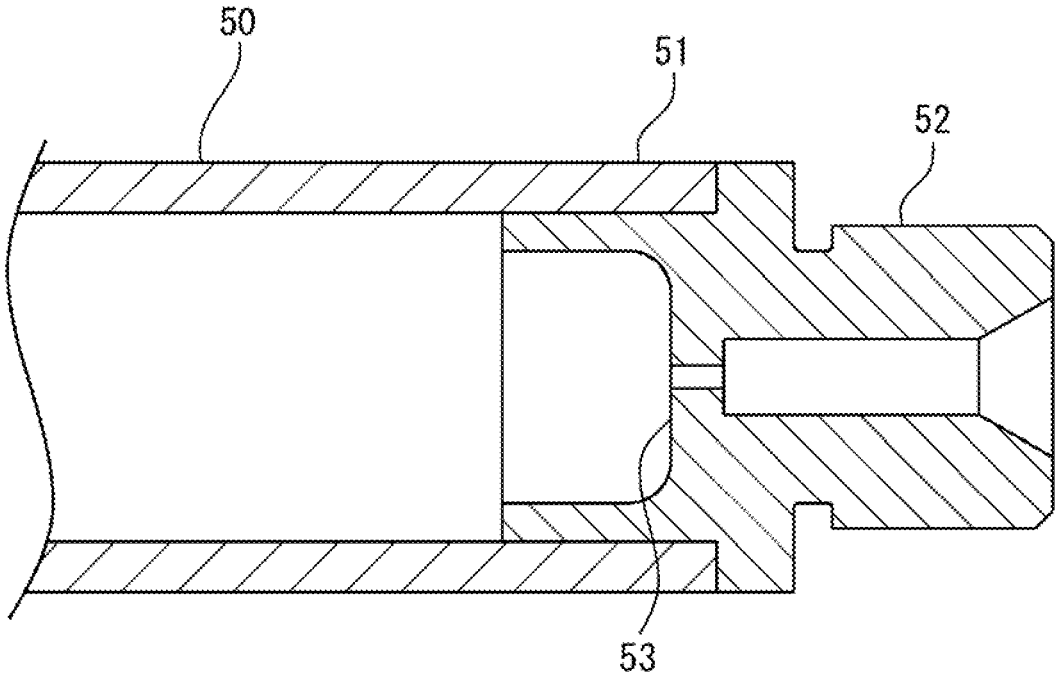
Related Art Figure 3
FIG. 3 is a partially enlarged cross-sectional view of a conventional example.

The first embodiment, which is the first invention of the present application, will now be described below with reference to FIG. 1. First, (1) denotes a rail body, and an inlet (2) that is a component formed separately from the rail body (1) is securely placed at a first end (15) thereof. The inlet (2) is provided with a fuel flow passage (4) on the distal end (3) side, the proximal end (6) side across an outer circumferential flange (5) from the distal end (3) side has a cylindrical shape, and this cylindrical part is an insertion part (7) inserted into the rail body (1). The outer diameter of the insertion part (7) is substantially the same as the inner diameter of the rail body (1).

A hollow part (8) that is in communication with the fuel flow passage (4) is provided inside the insertion part (7), and an opening (10) is provided on the proximal end (6) side. A flat-plate orifice (12) is securely placed on a distal end surface (11) of the insertion part (7) by brazing, and a small-diameter orifice hole (13) is formed to penetrate the center of the orifice (12). Securely placing the orifice (12) on the inlet (2) in this way makes it possible to simultaneously attach the orifice (12) and the inlet (2) during attachment to the rail body (1), and therefore attachment can be facilitated.

In this embodiment, the inlet (2) is integrally provided with the orifice (12) as described above, but other different embodiments are not limited thereto, and it is also possible that the inlet (2) and the orifice (12) are formed as separate components, first the orifice (12) is inserted into and placed in the rail body (1), and then only the inlet (2) is securely placed in the rail body (1) by brazing.

Then, in a state where the insertion part (7) of the inlet (2) formed as described above is inserted into and placed in the rail body (1), and the outer circumferential flange (5) of the inlet (2) is in contact with an end surface (14) of the rail body (1), the inlet (2) is securely placed in the rail body (1) by brazing. Accordingly, the orifice (12) is positioned in the rail body (1), and the hollow part (8) is positioned between the orifice (12) and the fuel flow passage (4) of the inlet (2).

Providing the hollow part (8) between the fuel flow passage (4) and the orifice (12) in this way makes it possible to provide a large inner volume between the orifice (12) and a high-pressure pump (not shown) that is in communication with the inlet (2) through a high-pressure pipe (not shown). It is thus possible to reduce pressure pulsation produced by the high-pressure pump. Accordingly, it is not necessary to increase the inner diameter of the high-pressure pipe, therefore it is also not necessary to utilize a high-strength material, and it is possible to suppress a cost increase.

Second Embodiment

In the first embodiment, the inlet (2) and the orifice (12) are integrally attached to the rail body (1), with the orifice (12) being securely placed on the inlet (2), but in the present embodiment, an inlet (21) and an orifice (31) are separately attached to a rail body (20). As for the second embodiment described below, the inlet (21) formed as a component separate from the rail body (20) is securely placed at a first end (34) of the rail body (20).

The inlet (21) is provided with a fuel flow passage (23) on the distal end (22) side, the proximal end (25) side across an outer circumferential flange (24) from the distal end (22) side has a cylindrical shape, and the cylindrical part is an insertion part (26) inserted into the rail body (20). An outer circumferential thread (37) is provided on the outer circumference of the insertion part (26), and an inner circumferential thread (36) that can be screw-fitted to the outer circumferential thread (37) is formed on the inner circumference on the first end (34) side of the rail body (20).

A hollow part (27) having an opening (28) on the proximal end (25) side is formed in the insertion part (26), and the hollow part (27) is in communication with the fuel flow passage (23). An engagement step (35) is provided on the inner circumference of the rail body (20) more towards the second end side than the inner circumferential thread (36) is, and a flat-plate orifice (31) is provided between the engagement step (35) and the opening (28) of the inlet (21). A small-diameter orifice hole (32) is formed to penetrate the center of the orifice (31).

Here, a method for attaching the inlet (21) and the orifice (31) to the rail body (20) will now be described. First, the orifice (31) is inserted into and placed in a portion of the rail body (20) where the orifice (31) is brought into contact with the engagement step (35) of the rail body (20). In this state, while screw-fitting the outer circumferential thread (37) of the insertion part (26) of the inlet (21) to the inner circumferential thread (36) of the rail body (20), the insertion part (26) of the inlet (21) is inserted into the rail body (20).

At the same time when the distal end surface (30) of the insertion part (26) is brought into contact with the surface of the orifice (31), the outer circumferential flange (24) of the inlet (21) is brought into contact with the end surface (33) of the rail body (20), and thereby attachment of the inlet (21) to the rail body (20) is completed. Attaching the inlet (21) and the orifice (31) to the rail body (20) as described above causes the orifice (31) to be positioned in the rail body (20) and the hollow part (27) to be positioned between the orifice (31) and the fuel flow passage (23) of the inlet (21).

Providing the hollow part (27) between the fuel flow passage (23) and the orifice (31) in this way makes it possible to increase the inner volume between the orifice (31) and a high-pressure pump (not shown) that is in communication with the inlet (21) through a high-pressure pipe (not shown). It is thus possible to reduce pressure pulsation produced by the high-pressure pump. Accordingly, it is not necessary to increase the inner diameter of the high-pressure pipe, therefore it is also not necessary to utilize a high-strength material, and it is possible to suppress a cost increase.

Moreover, as described above, securing the inlet (21) and the rail body (20) by screwing without requiring brazing facilitates connecting the inlet (21) and the rail body (20) such that they are unlikely separated, and also enables the orifice (31) to be rigidly and securely placed in the rail body (20) via the inlet (21).

DESCRIPTION OF THE REFERENCE NUMERALS

1, 20 Rail body
2, 21 Inlet
3, 22 Distal end
4, 23 Fuel flow passage
6, 25 Proximal end
7, 26 Insertion part
8, 27 Hollow part
12, 31 Orifice
15, 34 First end

The invention claimed is:

1. A gasoline direct injection rail, comprising:

a rail body; and an inlet that is provided between the rail body and a high-pressure pump, the inlet being connected to an end of the rail body, wherein the inlet has a fuel flow passage and an insertion part inserted into the rail body, an orifice is provided on a distal end surface of a downstream side of the insertion part, the downstream side being a side farther from the high-pressure pump, an orifice hole having a diameter smaller than a diameter of the fuel flow passage is formed to penetrate a center of the orifice, the orifice hole is provided on a plane, which is on the same plane as the distal end surface of the downstream side of the insertion part, the same plane is vertical to a flowing direction of a fuel, the insertion part of the inlet has a hollow part to increase an inner volume of the fuel flow passage from the high-pressure pump to the orifice, and the hollow part is positioned in the fuel flow passage from the high-pressure pump to the orifice.

2. The gasoline direct injection rail according to claim 1, wherein the orifice is integrally provided in the insertion part of the inlet.

3. The gasoline direct injection rail according to claim 1, wherein the orifice is provided as a component separate from the inlet and the rail body.

4. The gasoline direct injection rail according to claim 1, wherein an engagement step is provided on an inner circumference of the rail body, and the orifice and the orifice hole are provided between the engagement step and an opening of the inlet.

5. The gasoline direct injection rail according to claim 1, wherein a distance between the orifice hole and the end of the surface of the rail body in the flowing direction of the fuel is the same as the distance between the distal end surface of the downstream side of the insertion part and the end surface of the rail body in the flowing direction of the fuel.

* * * * *